United States Patent [19]

Uchin

[11] Patent Number: 4,649,973

[45] Date of Patent: Mar. 17, 1987

[54] EVER-READY CAMERA CASE

[75] Inventor: Stanley Uchin, Marlboro, N.J.

[73] Assignee: Charles Beseler Company, Florham Park, N.J.

[21] Appl. No.: 816,474

[22] Filed: Jan. 6, 1986

[51] Int. Cl.[4] ..... A45C 11/38; B65D 65/02

[52] U.S. Cl. ..... 150/52 J; 206/316; 224/202; 224/207; 224/258; 224/908

[58] Field of Search ..... 150/52 J, 106–108; 206/316; 190/102; 224/202, 207, 257, 258, 908, 909

[56] References Cited

U.S. PATENT DOCUMENTS

| | | | |
|---|---|---|---|
| D. 251,873 | 5/1979 | Pretzinger | D3/33 |
| D. 271,822 | 12/1983 | Clancy | D3/33 |
| 1,003,920 | 9/1911 | Kuhn | 150/107 |
| 2,172,348 | 9/1939 | Githens et al. | 150/52 J |
| 3,001,566 | 9/1961 | Lipsitz | 224/202 |
| 3,072,166 | 1/1963 | Buchholtz et al. | 150/52 J |
| 4,000,769 | 1/1977 | Katz | 150/52 J |
| 4,136,726 | 1/1979 | Lee | 150/52 J |
| 4,162,696 | 7/1979 | Sprung | 150/52 J |
| 4,232,808 | 11/1980 | Gray | 150/52 J X |

FOREIGN PATENT DOCUMENTS

| | | | |
|---|---|---|---|
| 66518 | of 1914 | Austria | 224/909 |
| 732200 | 2/1943 | Fed. Rep. of Germany | 206/316 |
| 2116244 | 10/1972 | Fed. Rep. of Germany | 150/52 J |
| 333075 | 8/1930 | United Kingdom | 150/108 |
| 531616 | 1/1941 | United Kingdom | 224/909 |

*Primary Examiner*—William Price
*Assistant Examiner*—Sue A. Weaver
*Attorney, Agent, or Firm*—Sperry, Zoda & Kane

[57] ABSTRACT

Disclosed is a soft camera case of the "ever-ready" type, in which the case is suspended by a carrying strap, in such a position as to provide swift and easy access to a camera, as for example when one observes a photographic subject and must take a photograph with minimum delay, lest the opportunity be lost. The case is so shaped as to be universally adapted to receive cameras of different makes and sizes, while yet protectively, snugly enclosing the same. A carrying strap has its ends connected directly to the camera, and has end portions loosely slidable in apertures provided in the cover of the case. Upon removal of the camera, the case is free to slide along the end portions of the strap until its cover engages shoulders provided upon the strap to limit further slidable movement. The end portions are adjustable in length, so that the case and camera will separate only to the extent desired by the particular user.

7 Claims, 7 Drawing Figures

EVER-READY CAMERA CASE

BACKGROUND OF THE INVENTION

1. Field of the Invention

The present invention relates generally to the field of carrying cases, and in a more particular sense to a camera case adapted to be suspended from a carrying strap worn about the user's neck or over the shoulder. In a still more specific sense, the invention has reference to a so-called "ever-ready" type of camera case, known in the art as cases designed to be carried on one's person in such a way as to provide immediate access to the camera housed in the case. The invention further relates to camera cases having carrying straps so designed as to be connectable directly to the housed camera, while engaged with the case in a way that will assure that the camera and case will be incapable of being completely separated in a way that may cause loss of one or the other of them.

2. Description of the Prior Art

Ever-ready camera cases are well known in and of themselves. Such cases are so designed as to be suspended by a carrying strap about the neck or over the shoulder of a user, in a position such that if the user desires access to a camera enclosed within the case, such access is instantaneously permitted. This is done by locating the cover of the case so that it faces upwardly, in many instances, whereby to permit the cover to be immediately unfastened, for removal of the camera. And, cases of this type most usually are shaped to fit a particular make and model of camera, so that they cannot generally be interchanged to receive other cameras.

This is a feature that has been found to be lacking in complete desirability, so far as the consumers are concerned, because this practice necessitates, generally, that the purchaser of a camera purchase a case (often at relatively high prices) offered by the camera manufacturer to fit that camera and no other. The desirability, thus, of a universal ever-ready case, can be readily seen, in that such a case can be manufactured at relatively low cost because it can be made in quantity to fit any of a wide variety of cameras while yet being of a quality matching that offered by the manufacturer of a case specifically designed for a specific camera.

The prior art, so far as is known,has not heretofore provided a case which is truly universal in the sense discussed above.

In the prior art, it has further been observed, arrangements utilizing a carrying strap for preventing complete separation of a camera and its carrying case, under circumstances when one needs instant access to the housed camera to prevent loss of a photographic opportunity, have been developed haphazardly at best. In some instances, the case may slide the full length of the looped carrying strap, so as to fall to the ground or become entangled with nearby objects. In other instances, there is an undesirable loss, even of a few seconds, in getting the camera out of the case and getting the case out of the way, when a photographic opportunity presents itself.

In either event, the arrangements heretofore developed for making a camera captive to its case and vice versa, have failed to permit access to the housed camera, with maximum speed, and movement of the case away from the camera along the length of the strap no more than is desired by the particular user.

SUMMARY OF THE INVENTION

Summarized briefly, the present invention comprises a universal, ever-ready camera case, of soft, flexible material, so designed as to permit the case to receive any of a wide variety of cameras of different makes and sizes, while yet protectively and snugly enclosing the same when the camera is not in use.

The invention includes a cover which is hingedly connected to one end of the body of the case, in such a fashion as to permit the cover to be unfastened from the body with maximum speed and ease, completely disposing the camera ready for use with an absolute minimum of delay. In accordance with the invention, the camera is connected to the opposite ends of a looped carrying strap, the overall length of which can be varied to suit the particular user.

The end portions of the camera strap are loosely slidable in apertures provided in the cover of the case. Exteriorly of the cover and body of the case, the strap has abutments so located that when the case is opened, and the camera is removed, the cover, and hence the entire case, will be caused to immediately slide along the length of the carrying strap, up to the abutments. There, the cover is engaged by the abutments against further slidable movement along the length of the strap.

The portions of the strap between the camera and the abutments are adjustable in length, so that the user can select the distance that the case will be permitted to slide away from the camera when the camera is removed.

BRIEF DESCRIPTION OF THE DRAWING

While the invention is particularly pointed out and distinctly claimed in the concluding portions herein, a preferred embodiment is set forth in the following detailed description which may be best understood when read in connection with the accompanying drawings, in which:

DESCRIPTION OF THE PREFERRED EMBODIMENT

Figure 1:
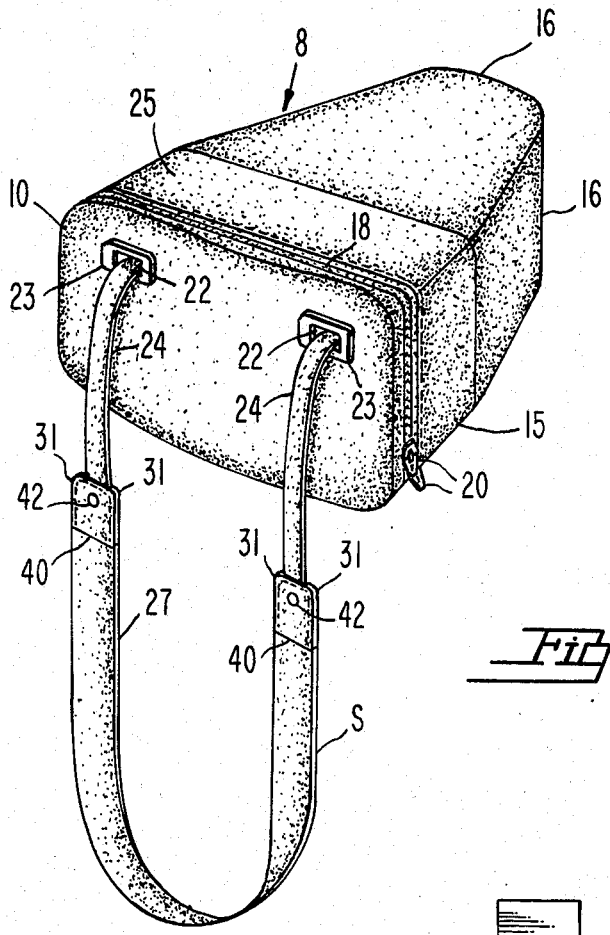
FIG. 1 is a perspective view of an ever-ready camera case according to the present invention, as it appears when closed.

The camera case 8 comprising the present invention includes a cover 10 of soft, flexible material integrally or otherwise permanently hinged along its bottom edge 12 to the body 14 of the case.

Body 14 is also formed of soft, flexible material, and may be suitably lined or otherwise interiorly padded to protect the housed camera.

In accordance with the invention, the body has a generally rectangular end portion 15, merging into a tapered, closed end portion 16. As seen from FIG. 4, the bottom wall 17 of the case lies in a single plane, generally normal to the plane of the cover 10 when the cover is closed. Further, the rear end wall 19 of the body lies in a generally flat plane parallel to the plane of the cover. The top wall 21 of the tapered, closed end portion 16 lies in a plane inclined relative to the plane of the bottom wall, whereas the top wall 25 of the rectangular end portion 15 of the body lies generally in a plane that is parallel to the plane of the bottom wall 17.

A slide fastener 18 extends along the side and top edges of the cover 10 and the rectangular body portion 15, and is of the double type having two slides 20. The fastener can thus be closed by either or both slides, thereby permitting one to leave an opening between the cover and the camera case body at any selected location along the sides and top of the case.

Figure 5:
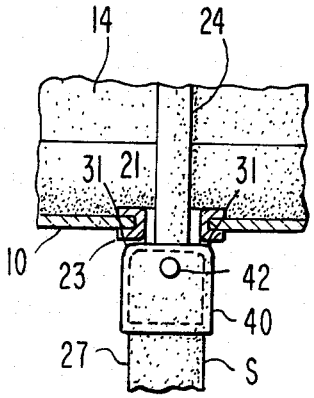
FIG. 5 is an enlarged, fragmentary, detail sectional view taken substantially on line 5—5 of FIG. 2, showing the abutment means.

Formed in the cover, at transversely spaced locations, are slot-like apertures 22 (FIGS. 1 and 5). As shown, these are preferably reinforced by metal grommets 23.

A carrying strap S has narrow end portions 24 having at their distal ends attaching rings 26 adapted to be connected to connecting loops or lugs 28 projecting from the front face of a conventional camera 30. The narrow end portions 24 are secured to the opposite ends of a wider intermediate portion 27, thus defining abutment means at the juncture between the proximal ends of the end portions 24 and the respective ends of the intermediate portion 27. The abutment means, due to the greater width of the intermediate portion 27, is in the form of a pair of shoulders 31 located at opposite sides of each end portion 24 of the strap.

Figure 2:
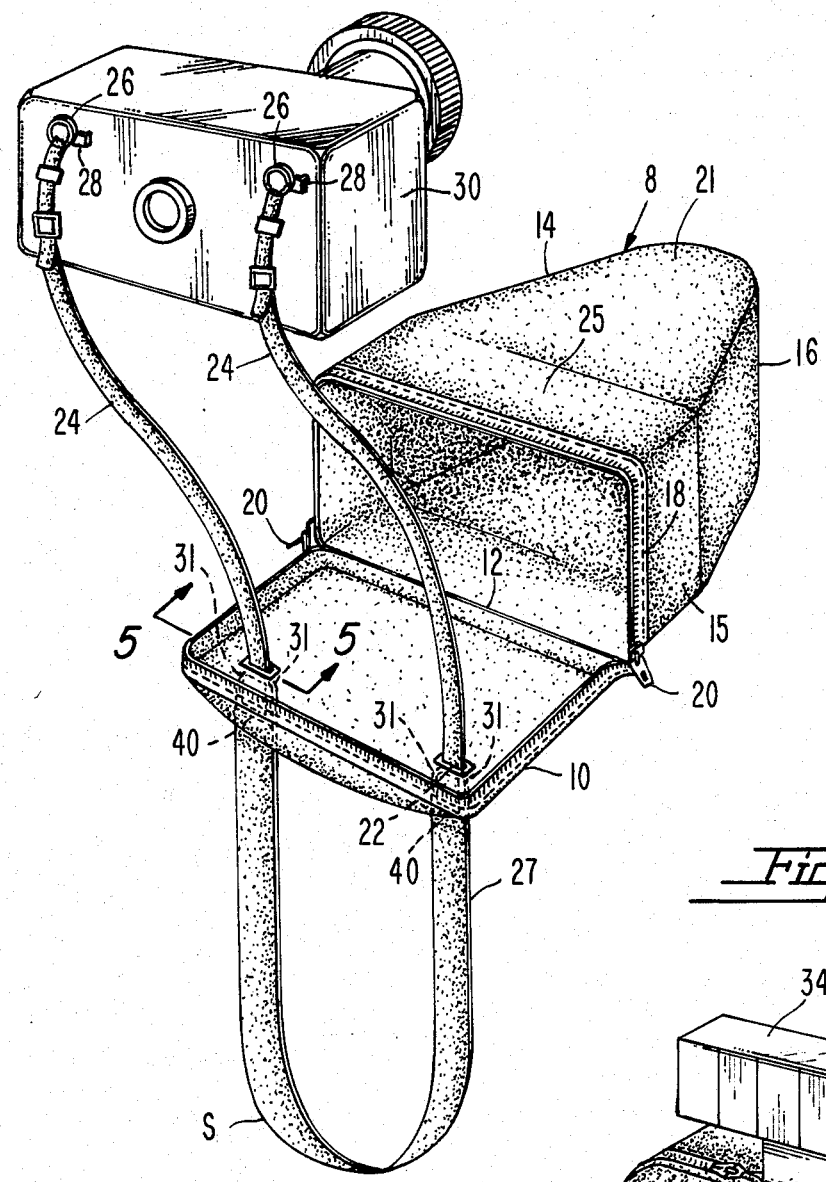
FIG. 2 is a view similar to FIG. 1, the case being opened and the housed camera being removed.

There is thus a pair of abutment means, transversely aligned upon the strap, both of which are located the same distance from the connections of the strap to the camera. When, accordingly, the slide fastener 18 is opened, to permit the cover 10 to swing to open position as in FIG. 2, the camera may be removed, and when extracted from the case, can be separated from the cover 10 (and hence from the entire case) only by the length of the end portions 24.

Figure 4:
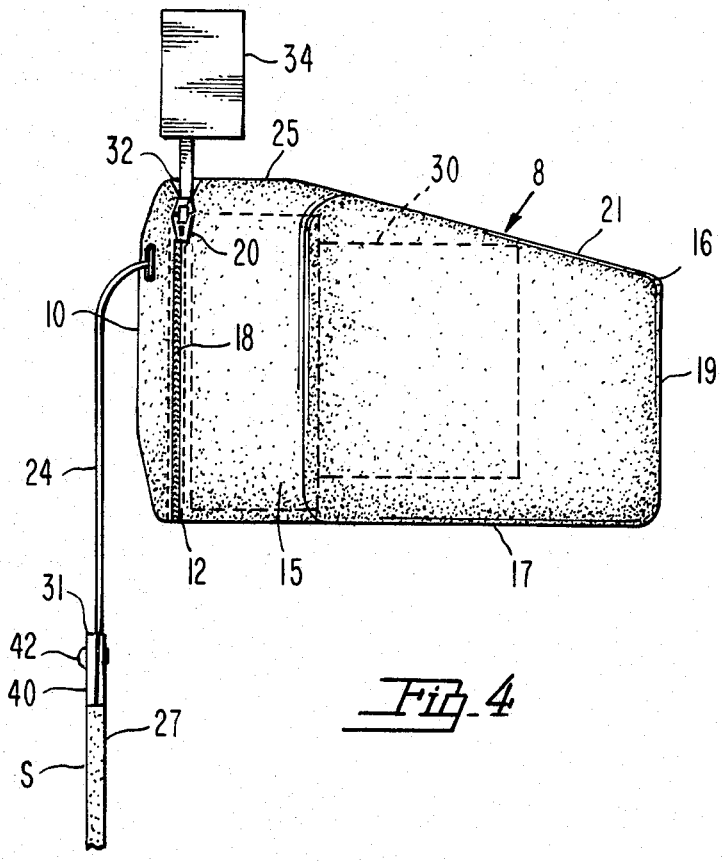
FIG. 4 is a side elevational view of the case with the flash bar attachment projecting therefrom, a portion of the carrying strap being broken away.
Figure 3:
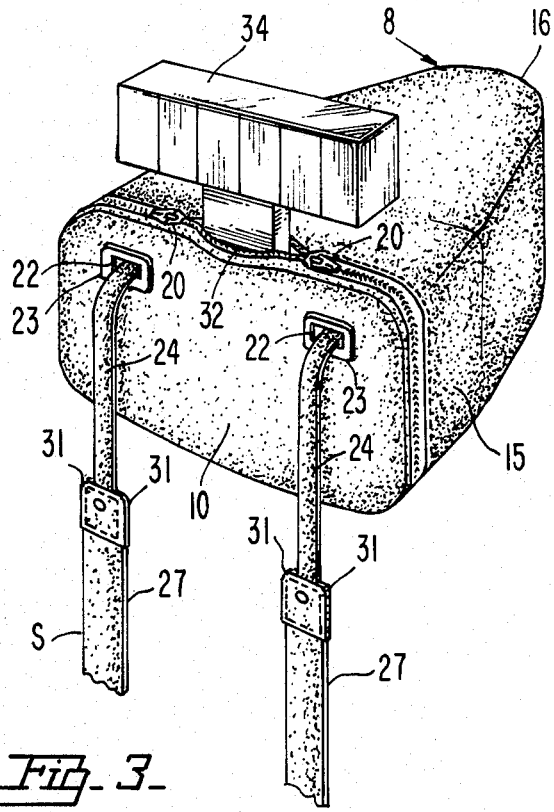
FIG. 3 is a perspective view similar to FIG. 1, in which a portion of the carrying strap has been broken away, the case being shown as capable of housing a camera with a flash bar attachment projecting exteriorly of the case.

At this point, it may be noted that as another feature of the device, in some circumstances one may want to leave a flashbar attachment attached to the camera, in ready position in the event a photographic opportunity should develop. In these circumstances, the flashbar attachment is left attached to the camera as shown in FIGS. 3 and 4, and the slides 20 are operated to leave a central opening 32 in the top of the camera case, located midway between opposite sides thereof. The base of the flashbar attachment 34 can thus project through this opening, although the camera itself is completely enclosed in the case and the cover 10 is in its closed position.

This further facilitates the capability of the camera case structure for providing instant access to the housed camera in the event of a photographic opportunity. With the flashbar attachment already in place, one simply operates the slides to permit the case to open as in FIG. 2, so that the camera is immediately removed and is ready for use, the entire case sliding automatically along the length of the end portions 24 of the strap to the extent permitted by the abutment means 31.

One is enabled to selectively adjust the distance that the camera case will travel along the strap from the camera in the circumstances discussed above. Each end portion 24 has an adjusting buckle 36 and an adjusting loop 38 which can be brought up close to the rings 26 for the purpose of closing the loop 39 holding rings 26. This is very desirable in that if the camera case were free to slide along the entire length of the strap S, it can be entangled with nearby objects, or act as a free swinging weight militating against one's being able to hold the camera steady while taking the photograph.

This would be true, for example, if one were to have the camera on a table, completely enclosed within the case. Opening the case and removing the camera to avail oneself of a suddenly presented photographic opportunity would ordinarily cause the camera case to fall to the floor or at least along the entire length of the strap, so as to entangle with adjacent objects, or otherwise cause the strap and camera case to suddenly constitute an elongated, weighted, free swinging assemblage that interferes with the taking of the photograph.

Figure 7:
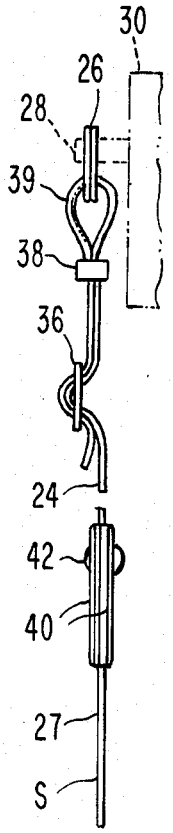
FIG. 7 is an edge elevational view of the strap illustrated in FIG. 6, portions being broken away, the associated camera again being illustrated fragmentarily and in dotted lines.
Figure 6:
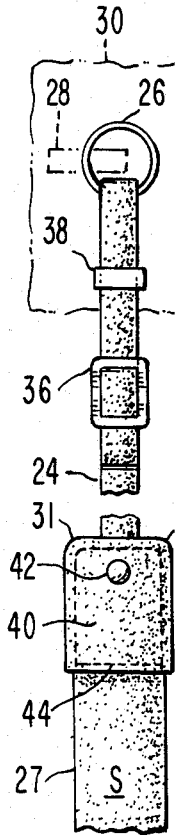
FIG. 6 is an enlarged, fragmentary elevational view of one of the end portions of the strap, a camera to which the strap is connected being illustrated fragmentarily and in dotted outline.

It may also be noted that the manner in which the wider intermediate portion 27 is connected to the narrower end portions 24 can vary. The arrangements shown in FIGS. 6 and 7 are preferred in the present instance, however. It is there shown that at the juncture of each end portion 24 with the intermediate portion 27, a pair of flat connecting pieces 40 encloses the portions 24, 27, and are stitched to the intermediate portion 27 and end portion 24 with a rivet 42 being extended through the connecting pieces and end portions 24 to further, permanently secure the connection therebetween.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A camera case, comprising:

(a) a flexible, hollow body of a shape corresponding generally to that of a camera to be carried therein and having an open end through which a camera may be inserted and removed;

(b) a flexible cover hingedly connected to said body for swinging movement between first and second positions in which, respectively, said cover closes and opens said end of the body, the cover having a pair of apertures spaced transversely thereof; and (c) a generally U-shaped carrying strap having end portions loosely slidably extended through said apertures and having means at its ends connectable to a camera receivable in said body, said strap including abutment means spaced longitudinally of the strap from the respective ends thereof, said abutment means being of a size to prevent passage thereof through the apertures and being disposed exteriorly of the body and cover in the closed position of the cover, whereby upon removal of a camera from the case the cover will be engaged by said abutment means for retention of the cover and body by the strap at a selected distance from the camera measured from the ends of the strap to the abutment means.

2. A camera case as in claim 1 wherein said strap has an intermediate portion joined to the end portions, said intermediate portion being of a greater width than the end portions, said abutment means being disposed at the juncture of the intermediate portion with the end portions.

3. A camera case as in claim 2 wherein said abutment means comprises shoulders provided on the strap at said juncture of the intermediate portion with the end portions thereof.

4. A camera case as in claim 2 wherein said abutment means comprises connecting elements secured to the intermediate and end portions of the strap where said intermediate and end portions are joined together, said elements being proportioned to prevent passage thereof through said openings.

5. A camera case as in claim 1 wherein said end portions include means for adjusting the length of the end portions, whereby to selectively vary the distance between the camera and case when the camera is removed and the cover is engaged by the abutment means.

6. A camera case as in claim 1, further including means for fastening the cover about its periphery to the body in the closed position of the cover, said cover-fastening means being adapted to leave an open area in which the periphery of the cover remains unfastened to the body so as to permit projection, through said open area, of a flash bar attached to said camera.

7. A camera case including:

(a) a hollow body having an open end, said body being contoured to generally follow the outlines of a camera housed therein;

(b) a cover hinged to said body for closing the same at its open end, said cover having a pair of apertures; and (c) a carrying strap having ends adapted for connection to said camera, said strap being loosely slidable in said apertures, said strap including a pair of abutment means thereon located exteriorly of the cover and body at a distance from the respective ends of the strap, the apertures being proportioned to prevent passage of the abutment means therethrough, the strap including means for adjusting the distance between the abutment means and the respective ends of the strap whereby to selectively vary said distance and thereby locate the case at a selected location along the length of the strap when the camera is removed from the case.

* * * * *